US006354271B1

(12) United States Patent
Satapathy

(10) Patent No.: US 6,354,271 B1
(45) Date of Patent: Mar. 12, 2002

(54) HYDRAULICALLY-ACTUATED FUEL INJECTOR WITH ENHANCED PEAK INJECTION PRESSURE AND STEPPED TOP INTENSIFIER

(75) Inventor: Manas R. Satapathy, Aurora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/734,445

(22) Filed: Dec. 11, 2000

(51) Int. Cl.[7] ..... F02M 37/04
(52) U.S. Cl. ..... 123/446; 123/496
(58) Field of Search ..... 123/299, 300, 123/446, 496, 467

(56) References Cited

U.S. PATENT DOCUMENTS

| | | | | |
|---|---|---|---|---|
| 2,235,365 A | | 3/1941 | Grumbt | |
| 3,747,857 A | | 7/1973 | Fenne | |
| 4,205,790 A | | 6/1980 | Keiczek | |
| 4,402,457 A | | 9/1983 | Walter | |
| 4,413,780 A | | 11/1983 | Skinner et al. | |
| 4,601,269 A | | 7/1986 | Kato et al. | |
| 5,517,972 A | | 5/1996 | Stockner | |
| 5,651,345 A | * | 7/1997 | Miller et al. | 123/446 |
| 5,655,501 A | * | 8/1997 | Hafner | 123/496 |
| 5,826,562 A | | 10/1998 | Chen et al. | |
| 5,842,452 A | | 12/1998 | Pattanaik | |
| 5,868,317 A | | 2/1999 | English | |
| 5,878,720 A | * | 3/1999 | Anderson et al. | 123/496 |
| 5,890,471 A | * | 4/1999 | Nishimura | 123/496 |
| 5,894,992 A | | 4/1999 | Liu et al. | |
| 6,082,332 A | * | 7/2000 | Hefler et al. | 123/446 |
| 6,085,726 A | * | 7/2000 | Lei et al. | 123/446 |

FOREIGN PATENT DOCUMENTS

| | | |
|---|---|---|
| DE | 834471 | 3/1952 |
| GB | 2194600 | 3/1988 |
| JP | 404234560 A | 8/1992 |

OTHER PUBLICATIONS

English Language translation of "Heavy Duty Diesel Engines—The Potential of Injection Rate Shaping for Optimizing Emissions and Fuel Consumption", presented by Messrs. Bernd Mahr, Manfred.

Durnholz, Wilhelm Polach, and Hermann Grieshaber, Robert Bosch GmbH, Stuttgart, Germany, at the 21st International Engine Symposium, May 4–5, 200, Vienna, Austria.

* cited by examiner

*Primary Examiner*—Carl S. Miller
(74) *Attorney, Agent, or Firm*—Michael B. McNeil

(57) ABSTRACT

A hydraulically actuated fuel injector includes an injector body that defines a fuel nozzle outlet and a plurality of passages, including high pressure actuation fluid passages, and low pressure drainage and vent passages. A piston with at least one hydraulic surface is movably disposed between retracted and advanced positions along a stroke distance in a piston bore defined by the injector body. When acted upon by high pressure actuation fluid, the piston, in cooperation with a plunger, advances from its initial retracted position a certain stroke distance before it uncovers and exposes an actuation fluid flow enhancement annulus. Exposure of the piston hydraulic surface(s) to the additional flow capacity provided via the actuation fluid flow enhancement annulus yields higher piston and plunger acceleration rates, resulting in sustained high piston acceleration and a higher peak fuel injection pressure and flow rate.

20 Claims, 2 Drawing Sheets

HYDRAULICALLY-ACTUATED FUEL INJECTOR WITH ENHANCED PEAK INJECTION PRESSURE AND STEPPED TOP INTENSIFIER

TECHNICAL FIELD

The present invention relates generally to hydraulically-actuated fuel injectors, and more specifically to stepped top pistons and rate shaping in hydraulically-actuated fuel injectors.

BACKGROUND ART

It has long been known in the art that the power, efficiency and exhaust emissions of fuel injected internal combustion engines are significantly dependent upon various fuel injection parameters, including injection flow rate and variation in injection flow rate during the injection cycle. Of particular importance to our society is the reduction of undesirable engine emissions. It has thus been sought in the art to control fuel flow rate during the injection cycle by various schemes, sometimes referred to as rate-shaping, in reference to the profile of a plot of fuel flow rate versus time during an injection cycle.

Many attempts at rate shaping have been successfully implemented in hydraulically-actuated fuel injectors. Typically, the basis of operation of such injectors is as follows: a moderately high pressure actuation fluid is directed to act upon an intensifier piston with a relatively large hydraulic surface area. The piston in turn acts upon a plunger, which pressurizes the fuel. The piston has a much greater hydraulic area than the plunger; by virtue of the relative hydraulic surface areas, the fuel pressure may be magnified to many times that of the actuation fluid pressure. In other words, fuel injection pressure is proportional to the product of the actuation pressure and the intensifier piston/plunger hydraulic area ratio. While these types of injectors have been in use for many years, engineers are continuously looking for ways to improve their performance through rate shaping.

It has been found in the art that engine emissions can be significantly reduced at certain operating conditions by controlling the injection rate shape. A preferable rate shape may be generally characterized by a relatively low fuel flow rate at the beginning of the injection cycle, followed by a controlled increase to a peak flow, and with an abrupt termination of fuel flow at the end of the cycle. Such a rate shape has been found to reduce undesirable engine emissions at some operating conditions.

One method for implementing a rate-shaping scheme is discussed in U.S. Pat. No. 5,826,562 to Chen et al, which recognizes that front end rate shaping may be implemented, in one embodiment, through the use of a stepped intensifier piston. Such a piston includes two hydraulic surfaces that are separated by a cylindrical portion. The smaller diameter piston portion, referred to as the top hat portion, sits on top of the larger diameter portion of the piston. The end face of the top hat portion constitutes the top hat's smaller hydraulic surface, and the exposed portion of the face of the larger diameter portion of the piston, annular in shape, constitutes the larger hydraulic surface. Such a stepped intensifier piston operates in a stepped bore comprising two concentric cylindrical surfaces, designed such that relatively close diametrical clearances exist between the stepped intensifier piston cylindrical surfaces and the stepped bore cylindrical surfaces. The stepped bore is further designed such that when its annular face is in contact with the exposed annular face surface of the larger diameter portion of the piston, which condition is a result of forces applied by the piston's return spring, a slight gap exists between the smaller diameter bore's end face and the piston's top hat portion hydraulic surface.

In such a system, the actuation fluid is typically provided via a port in the end face of the smaller diameter portion of the bore. Accordingly, during the beginning of an injection cycle the actuation fluid acts primarily on the top hat hydraulic surface, and results in a lower force acting upon the intensifier piston against the piston return spring and the plunger chamber fuel pressure, such that a certain corresponding fuel injection pressure and flow rate is achieved. As the injection cycle proceeds, the intensifier piston is driven further from its seated position, and the top hat piston portion eventually clears the small diameter portion of the bore, exposing the annular hydraulic surface of the larger diameter piston portion to the actuation fluid pressure. This increases the effective hydraulic surface area of the intensifier piston, resulting in an increased force being applied to the intensifier piston, and an increase in the fuel pressure and flow rate. Thus, during operation, the intensifier piston initially moves at a relatively slow speed, providing a relatively low injection rate, and later during the injection cycle, i.e., after the top hat piston portion clears the small diameter portion of the bore, accelerates to a greater speed, providing a relatively higher fuel injection rate. Notwithstanding the improvements in rate shape provided by this scheme, further improvements are possible.

As previously stated, the intensifier piston begins moving from its seated position at a relatively slow rate during the initial portion of the injection cycle, and during the latter portion of the cycle, accelerates to a greater speed. Necessarily, the greater the piston speed, the greater the actuation fluid flow rate required to maintain or to continue to accelerate that piston speed. Once the top hat piston portion begins to clear the small diameter portion of the bore, an increase in overall piston hydraulic area is exposed to actuation fluid pressure. As the piston continues to move downward in its stroke, the clearance between the top hat piston portion and the small diameter portion of the bore increases, exposing the piston's larger annular hydraulic surface to more actuation fluid. This causes more acceleration of the piston due to the actuation pressure acting on a larger area and thus providing a larger net force to the intensifier piston. The greater piston acceleration results in a higher fuel pressure, hence, the more the piston can be accelerated, the higher the peak fuel pressure. At this stage in the injection cycle, the required actuation fluid flow rate must increase sharply, relative to the flow rate during the initial portion of the injection cycle, to compensate for the accelerated motion of the piston. In order for the piston to maintain its higher speed or to accelerate to a greater speed, actuation fluid must be supplied at the same pressure, but with a greater flow rate. In order to improve injector performance, a means to provide an increase in available actuation fluid flow, at a designated point in the intensifier piston stroke, approximately in the vicinity of where the top hat piston portion clears the small diameter portion of the bore, is desirable. Thus, although rate shaping with a stepped piston has proven a viable concept, there exists room for improvement.

The present invention is directed towards overcoming these and other problems, and to improving the rate shaping performance and maximum fuel pressure in hydraulically-actuated fuel injectors.

DISCLOSURE OF THE INVENTION

A hydraulically actuated fuel injector includes an injector body defining an actuation fluid cavity that is fluidly connected to a piston bore via a plurality of actuation fluid passages. An intensifier piston having a side surface and a top, including a first hydraulic surface that is separated from a second hydraulic surface, is positioned in the piston bore, and is moveable a stroke distance between a retracted position and an advanced position. The first hydraulic surface of the intensifier piston is exposed to fluid pressure in a first cavity over a beginning portion of the intensifier piston's stroke distance via a relatively unrestricted first passage of the plurality of actuation fluid passages. The second hydraulic surface of the intensifier piston is exposed to fluid pressure in a second cavity over a beginning portion of the intensifier piston's stroke distance, via a second passage of the plurality of actuation fluid passages, having relatively restricted flow area. The injector body includes a third passage of the plurality of actuation fluid passages, having relatively unrestricted flow area, which is blocked by the side surface of the intensifier piston over a portion of its stroke distance.

In another aspect of the invention, a directly controlled fuel injector includes an injector body defining a nozzle outlet, a needle control passage, and an actuation fluid cavity that is fluidly connected to a piston bore via a plurality of actuation fluid passages. An intensifier piston, having a side surface, and a top surface which includes at least one hydraulic surface, is positioned in the piston bore, and is moveable a stroke distance between a retracted position and an advanced position. The injector body includes a passage of the plurality of actuation fluid passages, having relatively unrestricted flow area, which is blocked by the side surface of the intensifier piston over a portion of its stroke distance. The directly controlled fuel injector also includes a needle valve member that is positioned in the injector body adjacent to the nozzle outlet. The needle valve member includes a closing hydraulic surface that is exposed to the fluid pressure in the needle control passage.

Yet another aspect of the invention is a method of front end rate shaping in a hydraulically actuated fuel injector. Realization of this method includes the step of driving an intensifier piston of a hydraulically actuated fuel injector with a small hydraulic force over a beginning portion of its stroke. This is accomplished in part by covering one of the plurality of actuation fluid passages with the intensifier piston during the beginning portion of its stroke. This method also includes the step of opening a nozzle outlet of the fuel injector, accomplished in part by relieving hydraulic pressure on a closing hydraulic surface of a needle valve member. This method additionally includes the step of driving the intensifier piston with a large hydraulic force for an other portion of it stroke, accomplished in part by moving the intensifier piston to a position that uncovers the one actuation fluid passage. This method further includes the step of closing the nozzle outlet, accomplished in part by resuming hydraulic pressure on the needle valve member's closing hydraulic surface.

BEST MODE FOR CARRYING OUT THE INVENTION

Figure 1:
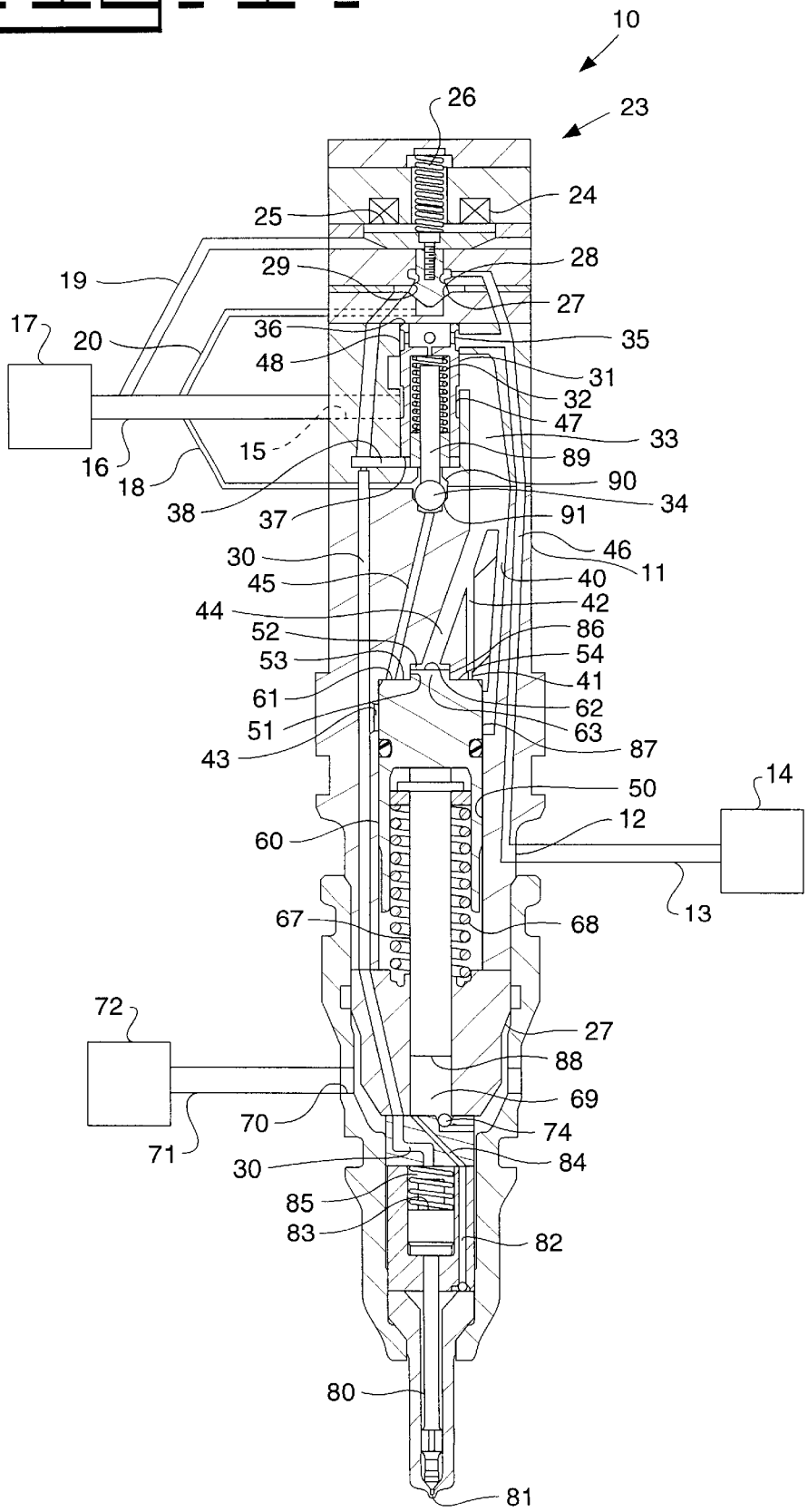
FIG. 1 is a diagrammatic cross-sectional view of a hydraulically-actuated fuel injector which incorporates the preferred embodiment of the present invention.
Figure 2:
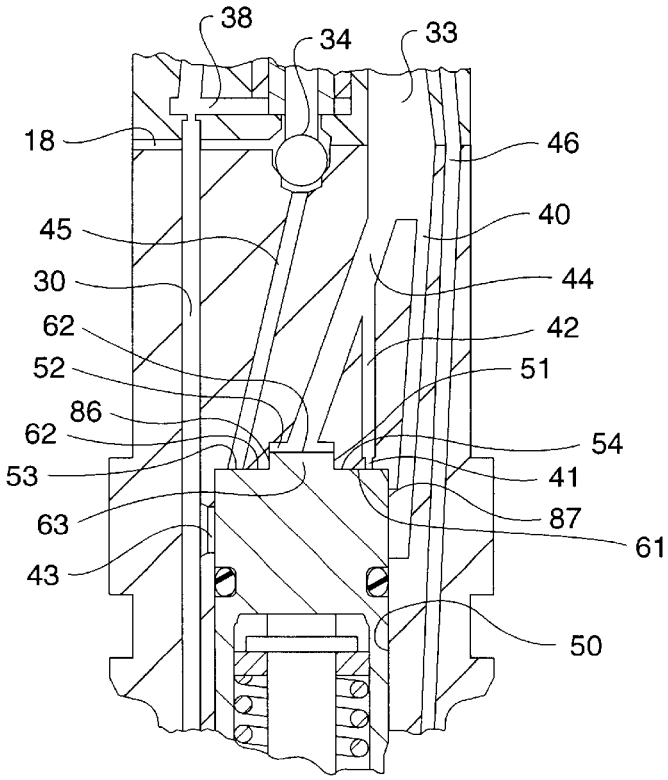
FIG. 2 is an enlarged partial diagrammatic cross-sectional view of a middle portion of the fuel injector of FIG. 1.

Referring to FIG. 1 and FIG. 2, a hydraulically-actuated electronically-controlled unit injector 10 is depicted, hereinafter referred to as a HEUI injector 10. The HEUI injector 10 includes an injector body 11 that defines various interface features, including an actuation fluid inlet port 12, an actuation fluid drain port 15, at least one fuel inlet port 70, a fuel delivery nozzle 81, and a means, not shown, for electrical connection to an electromechanical actuator 23. The actuation fluid inlet port 12 is in fluidic connection with a high pressure actuation fluid source 14 via an actuation fluid supply passage 13. The actuation fluid is preferably comprised of engine lubricating oil, but could be coolant, transmission fluid, fuel, or another fluid capable of being used in a conventional high pressure hydraulic system without precipitating deleterious effects in either the fluid itself, or any elastomeric, metallic, nonmetallic, or composite seals or components typically used in conventional hydraulic systems. The actuation fluid drain port 15 is in fluidic connection with low pressure drainage reservoir 17, such as an engine sump (oil pan), via a low pressure drain passage 16. Injector body 11 also defines a plurality of low pressure passages which are also in fluidic connection with low pressure drain passage 16, including an armature cavity vent 19, a control pressure vent 20, and a pressure relief vent 18. The fuel inlet port 70 or ports 70 are in fluidic connection with a source of fuel 72 via a fuel supply line or passage 71. The fuel delivery nozzle 81 is exposed to and in cooperation with a combustion cavity in the engine in which the HEUI injector 10 operates, and is preferably located in such a position in said combustion cavity so as to promote efficient fuel combustion in the individual engine cylinder in which the HEUI injector 10 operates. HEUI injector 10 is controlled by electrical signals which provide impetus to an electromechanical actuator 23, preferably a solenoid, but which could be any appropriate electrical or electromechanical actuation device including a piezoelectric actuator.

Electromechanical actuator 23, which is in this case a solenoid, includes a solenoid coil 24 and a movable armature 25 that is affixed to a pilot valve member 27 with conventional attachment or fastener means, and is normally biased in a downward direction by a pilot valve biasing spring 26. Pilot valve member 27 selectively operates, via armature 25 and via the selected energization or de-energization of solenoid coil 24, to seal against either pilot valve low pressure seat 28 or a pilot valve high pressure seat 29. When solenoid coil 24 is in the de-energized state, armature 25 and pilot valve member 27 are in the lower, biased position as shown. When in the lower, biased position, pilot valve member 27 is seated against pilot valve low pressure seat 28, hydraulically exposing a pressure control passage 30 to fluidic connection via pilot valve high pressure seat 29 with a high pressure passage 46 that is in fluidic connection with actuation fluid inlet port 12. When seated against pilot valve low pressure seat 28, pilot valve member 27 prevents hydraulic the exposure of control pressure vent 20 to high pressure passage 46.

When solenoid coil 24 is in the energized state, as would occur during a fuel injection cycle, armature 25 and hence pilot valve member 27 are pulled upward in response to and in cooperation with magnetic flux generated in solenoid coil 24. When in the upper position, pilot valve member 27 is seated against pilot valve high pressure seat 29, hydraulically exposing pressure control passage 30 to fluidic connection via pilot valve low pressure seat 28 to a control pressure vent 20 which is in fluidic connection with low pressure drainage sump 17 via a low pressure drain passage 16. Thus, when solenoid coil 24 is energized, pressure control passage 30 is connected to a source of low pressure fluid.

A spool valve member 31 is positioned in injector body 11, and is biased towards a first and upper position by a spool valve biasing spring 32, as shown in FIG. 1. An upper annular hydraulic surface 36 of spool valve member 31 and the hollow internal surfaces of spool valve member 31 are continually exposed to the high pressure of actuation fluid inlet 12 via a plurality of spool valve member radial passages 35 and high pressure passage 46. A lower annular hydraulic surface 37 of spool valve member 31 is in fluidic connection with pressure control passage 30 via branch control passage 38, which tees into control passage 30. The hydraulic surface area of the upper and lower hydraulic surfaces of spool valve member 31 are preferably approximately the same, but could be different if desired.

When pressure control passage 30 is hydraulically exposed to and in fluidic connection with actuation pressure inlet 12 via control by pilot valve member 27, the pressures acting upon the opposing upper annular hydraulic surface 36 and lower annular hydraulic surface 37 of spool valve member 31 are approximately the same. The spool valve member 31 will thus move towards, or remain at, its upper position by the action of and in cooperation with spool valve biasing spring 32. When spool valve member 31 is in its first and upper position, actuation fluid cavity 33 is hydraulically exposed to and in fluidic connection with actuation fluid drain 15 via a first and lower positioned wide aspect ratio distribution groove 47, which is machined into the outer cylindrical surface of spool valve member 31. When spool valve member 31 is in its upper position, actuation fluid cavity 33 is closed to actuation fluid inlet 12.

When pressure control passage 30 is in fluidic connection with actuation fluid drain 15 via control by pilot valve member 27, the pressure acting upon upper annular hydraulic surface of spool valve member 31 is greater than the pressure acting upon lower annular hydraulic surfaces of spool valve member 31, and furthermore, the net hydraulic force acting on the spool valve member 31 is greater than the opposing force provided by spool valve biasing spring 32. The spool valve member 31 will thus retract from its first and upper position and move towards and attain a second and lower position. When spool valve member 31 is in its second and lower position, actuation fluid cavity 33 is hydraulically exposed to and in fluidic connection with actuation fluid inlet 12 via high pressure passage 46 and via a second and upper positioned wide aspect ratio distribution groove 48, which is machined into the outer cylindrical surface of spool valve member 31 at approximately the same axial location along the longitudinal axis of spool valve member 31 as the spool valve member radial passages 35. When spool valve member 31 is in its second and lower position, actuation fluid cavity 33 is closed to actuation fluid drain 15.

A pressure relief valve ball 34 is positioned below spool valve member 31, and is movably disposed in a pressure relief valve cavity 90, which includes a pressure relief valve seat 91 that is in fluidic connection with a pressure relief passage 45. Pressure relief valve cavity 90 is also in fluidic connection with pressure relief vent 18 that fluidly communicates with pressure drainage reservoir 17 via a low pressure drain passage 16. When spool member 31 is in its second and lower position, it acts upon and cooperates with pressure relief valve ball 34, via an actuator rod 89 that is affixed to spool valve member 31, so as to force pressure relief valve ball 34 against pressure relief valve seat 91, thus preventing pressure relief passage 45 from having fluidic connection with pressure relief vent 18. When spool member 31 is in its first and upper position, it does not act on or cooperate with pressure relief valve ball 34 via actuator rod 89; thus, the primary forces acting on pressure relief valve ball 34 under such condition are its own weight and any vibratorily imposed forces resulting from the environment in which HEUI injector 10 is located. Thus, when spool member 31 is in its first and upper position, pressure relief passage 45 is in fluidic communication with pressure relief vent 18 via pressure relief valve seat 91 and pressure relief valve cavity 90.

When actuation fluid cavity 33 is in fluidic connection with actuation fluid inlet 12, the hydraulic surfaces of a stepped intensifier piston 60 are exposed to the actuation fluid pressure of actuation fluid cavity 33 via top hat actuation fluid passage 44, and via a rate shape orifice 41 through a rate shape orifice-passage 42. Stepped intensifier piston 60 includes a first top hat piston portion 63 which incorporates a top hat hydraulic surface 62, relatively small and preferably but not necessarily circular in shape. Top hat piston portion 63 also includes a top hat piston skirt portion 86 as an approximate downward projection of top hat hydraulic surface 62, which surface is preferably but not necessarily cylindrical in shape and concentric with top hat hydraulic surface 62, and which surface is separated from top hat hydraulic surface 62. Stepped intensifier piston 60 further includes a second relatively larger hydraulic surface 61, preferably but not necessarily annular in shape and concentric with hydraulic surface 62, and which joined to top hat piston portion 63. Larger hydraulic surface 61 is bounded by a piston side surface 87, which is an approximate downward projection of the outer periphery of larger hydraulic surface 61, and which may include provision for the incorporation of sealing means, depicted in FIG.1 as an elastomeric o-ring gland and seal, but which may include provision for any suitable sealing means or may not include provision for sealing means.

Stepped intensifier piston 60 is axially slidably disposed in a stepped intensifier piston bore that is comprised of a main piston bore 50 and a relatively smaller top hat piston bore 51, and is biased towards a first upper retracted position by a stepped intensifier piston return spring 68 acting on stepped intensifier piston 60 via a plunger 67. The upper end of top hat piston bore 51 is hydraulically exposed to and in fluidic connection with actuation fluid cavity 33 via top hat actuation fluid passage 44 and a top hat pressurization cavity 52, exposing top hat hydraulic surface 62 to actuation fluid flowing to or from top hat actuation fluid passage 44. The upper end of main piston bore 50 defines a larger pressurization cavity 53 that is in fluidic connection with actuation fluid cavity 33 via rate shape orifice 41 and exposed to fluid pressure in rate shape orifice-passage 42. In addition, the upper end of main piston bore 50 is exposed to and in fluidic connection with pressure relief passage 45. Furthermore, the upper end of main piston bore 50 axially locates the retracted position of stepped intensifier piston 60 by contact with a piston stop surface 54, which is included in and part of larger hydraulic surface 61. When stepped intensifier piston 60 in its first upper retracted position, top hat hydraulic surface 62 and larger hydraulic surface 61 are substantially fluidly isolated from one another, except via a radial or diametrical clearance between top hat piston bore 51 and top hat piston skirt portion 86 of stepped intensifier piston 60. Main bore 50 incorporates an actuation fluid flow enhancement annulus 43 that is hydraulically exposed to and in fluidic connection with a plurality of actuation fluid enhanced flow passages 40 that are in fluidic connection with actuation fluid cavity 33.

The hydraulic surfaces of stepped intensifier piston 60 are sized such that during an injection cycle, the stepped intensifier piston 60 will initially begin moving from its first upper retracted position primarily as a result of high pressure actuation fluid acting on top hat hydraulic surface 62 via top hat actuation fluid passage 44. Rate shape orifice 41 restricts flow into the volume above larger hydraulic surface 61 so that the pressure force acting on larger hydraulic surface 61 is relatively low. In other words, the pressure force on larger hydraulic surface 61 while top hat hydraulic surface 61 is inside top hat piston bore 51 is very small. A direct control needle valve 80 is located in the bottom portion of HEUI injector 10, and incorporates a needle valve closing hydraulic surface 83 that is exposed to hydraulic pressure in needle control chamber 85. Direct control needle valve 80 is biased towards its downward closed position by a needle biasing spring 84. Needle control chamber 85 becomes pressurized via pressure control passage 30 when pressure control passage 30 is hydraulically exposed to and in fluidic connection with actuation pressure inlet 12 via control by pilot valve member 27. Hydraulic pressure in needle control chamber 85 acts on needle valve closing hydraulic surface 83, keeping direct control needle valve 80 in a closed position, with the aid of needle biasing spring 84. The combination of the hydraulic pressure acting on needle valve closing hydraulic surface 83 and the force provided by needle biasing spring 84 overcomes any opposition generated by high pressure fuel acting on opposing hydraulic surfaces of direct control needle valve 80 through nozzle supply line 82. In order to begin an injection cycle, solenoid coil 24 is energized, pulling armature 25 and hence pilot valve member 27 in an upward direction, seating pilot valve member 27 against pilot valve high pressure seat 29, and hydraulically exposing pressure control passage 30 to fluidic connection with control pressure vent 20. This relieves needle control chamber 85 of high pressure, and allows direct control needle valve 80 to be pushed into an upper and open position by high pressure fuel delivered via a nozzle supply line 82, thus allowing fuel to be delivered into the combustion chamber via a nozzle outlet 81.

Stepped intensifier piston 60 acts in cooperation with plunger 67 as follows: when stepped intensifier piston 60 moves from its first upper retracted position, it drives plunger 67 in an downward advancing direction. This pressurizes the fuel in fuel pressurization chamber 69 via a plunger hydraulic surface 88, delivering the fuel to direct control needle valve 80 via nozzle supply line 82. This fuel pressure, exerted against direct control needle valve 80 lower hydraulic surfaces, pushes direct control needle valve 80 into an upper and open position, resulting in an initial flow of fuel with rate shaped ramp increase 92, depicted in FIG.3, from nozzle outlet 81. The initial flow of fuel with rate shaped ramp increase 92 is controlled by various design parameters, including the size and geometry the following: top hat hydraulic surface 62, larger hydraulic surface 61, top hat pressurization cavity 52, rate shape orifice 41, the vertical lengths of top hat piston skirt portion 86 and top hat piston bore 51, the radial or diametrical clearance between top hat piston skirt portion 86 and top hat piston bore 51 and other design parameters known in the art.

Figure 3:
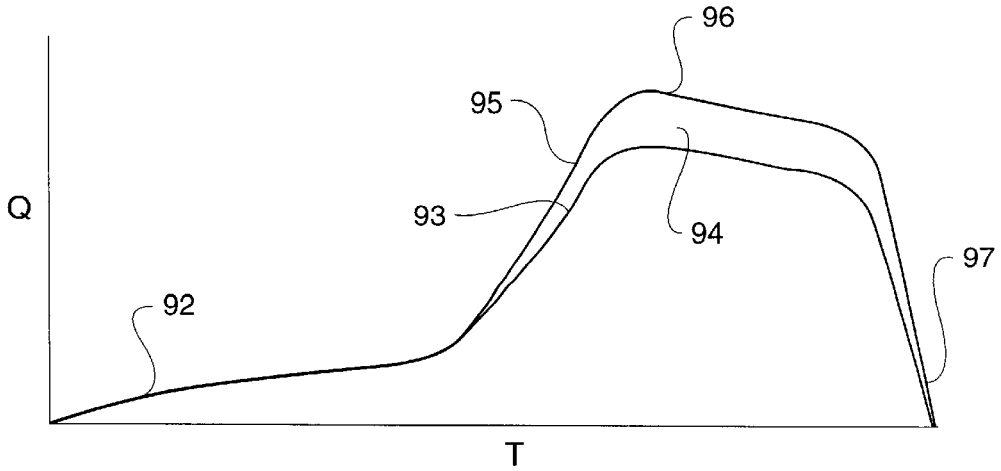
FIG. 3 is a graph of injection mass flow rate versus time for a single injection event, with and without the present invention.

As stepped intensifier piston 60 continues to move and accelerate from its first upper retracted position, top hat hydraulic surface 62 advances past and clears top hat piston bore 51, exposing larger hydraulic surface 61 to the higher rate of hydraulic flow from top hat actuation fluid passage 44, and causing stepped intensifier piston to advance at an even greater rate of acceleration, resulting in an increasing rate of fuel injection 93, depicted in FIG. 3. This requires a greater flow of actuation fluid in order to maintain that acceleration, especially given the much larger rate of increase of wetted piston/bore cavity volume associated with the sweeping downward of both the top hat hydraulic surface 62 and the greater hydraulic surface 61. As Piston side surface 87 and larger hydraulic surface 61 clear actuation fluid flow enhancement annulus 43, which is hydraulically exposed to and in fluidic connection with the plurality of actuation fluid enhanced flow passages 40 and hence with actuation fluid cavity 33, additional actuation fluid flow capacity is attained. Accordingly, with the greater flow capacity exposed to and acting upon the hydraulic surfaces of stepped intensifier piston 60, the rate of acceleration is further increased, with a sort of water hammer effect, resulting in a higher slope ramp increase in fuel flow 95, and a higher peak fuel pressure and flow rate 96. The axial location and size of actuation fluid flow enhancement annulus 43 and the point at which piston side surface 87 clears actuation fluid flow enhancement annulus 43 are design parameters, selected so as to provide a desired rate shape, including higher slope ramp increase in fuel flow 95 and higher peak fuel pressure and flow rate 96, depicted in FIG. 3. Preferably, actuation fluid flow enhancement annulus 43 is sized and positioned relative to the stroke of stepped intensifier piston 60 such that it becomes exposed at or shortly after top hat hydraulic surface 62 clears top hat piston bore 51. Thus, high pressure flow can act on larger hydraulic surface 61 due to combined flow from passage 44 past top hat piston skirt portion 86 and radially inward from actuation fluid enhanced flow passages 40 as Piston side surface 87 clears actuation fluid flow enhancement annulus 43.

In order to end the injection cycle, and with an abrupt termination of fuel flow, solenoid coil 24 is de-energized, allowing armature 25 to move towards and attain its lower, biased and normal position, seating pilot valve member 27 against pilot valve low pressure seat 28, and hydraulically exposing pressure control passage 30 to fluidic connection with actuation fluid inlet port 12 via pilot valve high pressure seat 29 and high pressure passage 46. The actuation fluid from pressure control passage 30 thus pressurizes needle control chamber 85, which pressure acts against needle valve closing hydraulic surface 83 to close direct control needle valve 80, abruptly preventing the flow of pressurized fuel 97, depicted graphically in FIG. 3, from nozzle outlet 81. With pressure control passage 30 and hence branch control passage 38 at high actuation fluid pressure, the pressures acting upon the opposing upper and lower annular hydraulic surfaces of spool valve member 31 are approximately the same, and the spool valve member 31 will move towards and attain its upper position by the action of and in cooperation with spool valve biasing spring 32. Spool valve member 31 is also given impetus in an upward direction by pressure relief valve ball 34, which at this point in the end phase of the injection cycle is still exposed to and acted upon by high pressure actuation fluid via pressure relief passage 45.

When spool valve member 31 is in its first and upper position, actuation fluid cavity 33 is hydraulically exposed to and in fluidic connection with actuation fluid drain 15 via the first and lower positioned wide aspect ratio distribution groove 47 of spool valve member 31. When spool valve member 31 is in its upper position, actuation fluid cavity 33 is closed to actuation fluid inlet 12, and is not acting upon pressure relief valve ball 34 via actuator rod 89, thus allowing exposure of pressure relief passage 45 to pressure relief vent 18. In order to prevent mechanical damage, system back pressure, adverse fluid-mechanical dynamic response or undesired fuel flow, any pressure spike associated with the abrupt termination of fuel flow is dissipated by flowing through pressure relief passage 45. With actuation fluid cavity 33 being exposed to the low pressure and the flow capacity actuation fluid drain 15, hydraulic pressure acting on the hydraulic surfaces of stepped intensifier piston 60 is substantially reduced, allowing stepped intensifier piston 60 to be driven back into its first upper retracted position by stepped intensifier piston return spring 68 acting upon stepped intensifier piston 60 via a plunger 67. While retracting, piston 60 pumps the now low pressure actuation fluid into actuation fluid drain 15. As the plunger 67 moves in the upward direction via stepped intensifier piston return spring 68, a new charge of low pressure fuel is pumped and drawn into fuel pressurization chamber 69 from fuel inlet port 70 through a fuel check valve 74. Fuel check valve 74 is designed to prevent the backflow of fuel into or through fuel inlet port 70 during an injection cycle.

Because spool valve member 31 and direct control needle valve 80 are controlled by the presence or absence of high pressure actuation fluid in pressure control passage 30, and because the pressurization and venting of pressure control passage 30 is hydraulically controlled by pilot valve member 27, it may be stated that pilot valve member 27 directly controls both spool valve member 31 and direct control needle valve 80. Because stepped intensifier piston 60 and pressure relief valve ball 34 are directly controlled by spool valve member 31, it may be stated that pilot valve member 27 indirectly controls stepped intensifier piston 60 and pressure relief valve ball 34 via spool valve member 31.

Industrial Applicability

Immediately prior to the start of an injection cycle, pilot valve member 27 is seated in its lower normal biased position sealing against pilot valve low pressure seat 28 thus exposing control pressure passage 30 to high actuation fluid pressure via high pressure passage 46 and actuation fluid inlet 12. Direct control needle valve 80 is seated in its lower normal biased position, closing fuel delivery nozzle 81, and spool valve member 31, stepped intensifier piston 60 and plunger 67 are in their normal upper biased positions. The hydraulic surfaces of stepped intensifier piston 60 are exposed to the low pressure actuation fluid drain port 15 via top hat actuation fluid passage 44, rate shape orifice-passage 42, actuation fluid cavity 33, and distribution groove 47 of spool valve member 31. In addition, fuel pressurization chamber 69, nozzle supply line 82, and the normally fuel wetted cavity surrounding the lower portion of direct control needle valve 80 are filled with fuel at a medium fuel supply pressure as provided by source of fuel 72. Needle control chamber 85 is filled with and pressurized by high pressure actuation fluid via control pressure passage 30.

The injection cycle is initiated by supplying electrical power to solenoid coil 24, resulting in a magnetic flux which attracts and pulls movable armature 25 and hence the pilot valve member 27, in an upward advancing direction to close high pressure seat 29. With pilot valve member positioned as such, control pressure passage 30 is exposed to the low pressure of control pressure vent 20. This eliminates the high actuation pressure that had been acting to hydraulically lock direct control needle valve 80, via needle control chamber 85 and needle valve closing hydraulic surface 83, in its lower seated position. This also eliminates the high actuation fluid pressure that had been acting on the lower annular hydraulic surface 37 of spool valve member 31, via branch control passage 38, to keep spool valve member 31 in its first and upper position. With the loss of high actuation pressure, direct control needle valve 80 is free to move to an unseated position and allow fuel to flow through fuel delivery nozzle 81 via fuel pressurization chamber 69 and nozzle supply line 82, once the fuel attains a valve opening pressure sufficient to overcome needle biasing spring 84. Also with the loss of high actuation fluid pressure on the lower annular hydraulic surface 37 of spool valve member 31, that spool valve is moved into its second and lower position by virtue of the hydraulic pressure acting on its upper annular hydraulic surface 36. Pressure relief valve ball 34 is moved against pressure relief valve seat 91 via actuator rod 89, thus closing pressure relief passage 45 from fluidic connection with pressure relief vent 18. With spool valve member 31 in its second and lower position, actuation fluid cavity 33 is exposed to high actuation pressure via distribution groove 47 of spool valve member 31, and high pressure passage 46 and actuation fluid inlet 12. The hydraulic pressure begins to act on the top hat hydraulic surface 62 of stepped intensifier piston 60 via top hat actuation fluid passage 44 which is an unrestricted passage. This hydraulic pressure causes stepped intensifier piston 60 to accelerate and begin moving in a downward direction against stepped intensifier piston return spring 68, hence forcing plunger 27 in a downward direction, pressurizing the fuel in fuel pressurization chamber 69 via plunger hydraulic surface 88. During this beginning portion of the pistons stroke, a relatively small hydraulic force acts to move the piston. This is because the relatively high pressure actuation fluid acts primarily only on the top hat portion of the piston, while the larger hydraulic surface of the piston is acted upon by relatively low pressure due to the flow restriction produced by rate shaping orifice 41. The pressurization of the fuel causes fuel check valve 74 to close. As fuel pressure continues to build, it reaches a sufficient pressure to overcome needle biasing spring 84. It thus forces direct control needle valve 80 in an upward and opening direction, thereby conveying high pressure fuel through fuel delivery nozzle 81. The initial flow of fuel with rate shaped ramp increase 92, depicted in FIG.3 are the purposeful result carefully selected design parameters, including but not limited to the geometry of: the stepped intensifier piston 60, including top hat piston portion 63 which incorporates a top hat hydraulic surface 62; top hat piston bore 51; and rate shape orifice 41. These and many other design parameters can be selected so as to provide a small initial injection flow rate during the beginning of the injection cycle, followed by a controlled increase in injection fuel flow rate as the injection cycle proceeds.

As piston top hat surface 62 begins to clear top hat piston bore 51, a small cylindrical opening is created between the advancing top hat surface 62 and the bottom of the top hat piston bore 51. This small area begins to allow high pressure actuation fluid to flow from top hat pressurization cavity 52 and to thus act on the piston larger hydraulic surface 61 in addition to top hat hydraulic surface 62. As stepped intensifier piston 60 continues in its downward stroke, the small cylindrical opening becomes progressively larger, allowing progressively more high pressure actuation fluid to act on larger hydraulic surface 61. This provides for additional acceleration of stepped intensifier piston 60, and hence for a further increasing rate of fuel injection 93. Because that cylindrical flow area is relatively small, the effect of pressure forces acting on larger hydraulic surface 61 is correspondingly relatively small. However, with the present invention, as piston top hat surface 62 begins to clear top hat piston bore 51, larger hydraulic surface 61 and Piston side surface 87 approximately simultaneously clear actuation fluid flow enhancement annulus 43. This directly and rapidly exposes larger hydraulic surface 61 to the high actuation fluid pressure of actuation fluid enhanced flow passages 40 via unrestricted actuation fluid flow enhancement annulus 43. Akin to water hammer effect, the pressure force acting on larger hydraulic surface 61 increases rapidly, as compared to that resulting from the aforementioned small cylindrical flow area. The reasons for such a rapid increase are at least twofold. The first reason is that owing to the significantly larger diameter of actuation fluid flow enhancement annulus 43, a corresponding significantly larger flow area exposes larger hydraulic surface 61 to high pressure actuation fluid. The second reason is that the source of high pressure actuation fluid, actuation fluid flow enhancement annulus 43, is in closer proximity to larger hydraulic surface 61 than the aforementioned small cylindrical opening. This allows high pressure actuation fluid from annulus 43 to flow to and act upon larger hydraulic surface 61 more quickly and readily than the high pressure actuation fluid flowing through the small cylindrical opening.

With the pressure force and water hammer effect acting on larger hydraulic surface 61 increasing rapidly, stepped intensifier piston 60 is more rapidly accelerated. Consequentially, plunger 67, acted upon by stepped intensifier piston 60, pressurizes fuel with a higher slope ramp increase in fuel flow 95, yielding a higher peak fuel pressure and flow rate 96.

It is important to note that absent the additional flow capacity and water hammer effect provided via actuation fluid flow enhancement annulus 43 through actuation fluid enhanced flow passages 40, lower peak injection pressures are realized. Such a result is undesirable, in that a high peak injection pressure and flow rate is preferable for purposes of engine combustion efficiency and the reduction of harmful engine emissions. The lower peak injection pressures of otherwise identical fuel injectors without actuation fluid flow enhancement annulus 43 of the present invention is likely caused as follows: as top hat piston portion 63 with top hat hydraulic surface 62 exit and move away from top hat piston bore 51, the entire hydraulic surface of stepped intensifier piston 60, and no longer just the smaller top hat hydraulic surface 62, becomes progressively exposed to high pressure actuation fluid. This represents a step change in the rate of increase of piston cavity volume, hence an increase in the rate of actuation fluid flow required to accelerate stepped intensifier piston 60, since a much larger hydraulic area is sweeping along the stroke distance of stepped intensifier piston 60. However, the actuation fluid acting on the larger hydraulic surface 61 is initially provided only through rate shaping orifice 41 and the small cylindrical opening that is created between the advancing top hat surface 62 and the bottom of the top hat piston bore 51. Because that opening provides only a relatively small flow area initially, high pressure actuation fluid flow to larger hydraulic surface 61 is initially restricted, thus providing reduced pressures to larger hydraulic surface 61 initially. As a result, acceleration of stepped piston 60 is accordingly limited.

The additional flow capacity provided via actuation fluid flow enhancement annulus 43 through the plurality of actuation fluid enhanced flow passages 40 allow a greater initial and sustained flow of high pressure actuation fluid to act upon the hydraulic surfaces of stepped intensifier piston 60. This results in even greater acceleration of stepped intensifier piston 60, and hence via the previously described injection scheme means, a higher slope ramp increase in fuel flow 95, and a higher peak fuel pressure and flow rate 96. The flow of fuel associated with higher slope ramp increase in fuel flow 95 and higher peak fuel pressure and flow rate 96, are the purposeful result of carefully controlled design parameters, including but not limited to the geometry, location, and features of: the stepped intensifier piston 60, including top hat piston portion 63 which includes top hat hydraulic surface 62 and top hat piston skirt portion 86, and larger hydraulic surface 61 with piston side surface 87; main piston bore 50 and top hat piston bore 51; and actuation fluid flow enhancement annulus 43 and actuation fluid enhanced flow passages 40. For example, the height of top hat piston skirt portion 86, is preferably similar in length to the stroke distance along main piston bore 50 from its upper extent down to the location of enhancement annulus 43. This would allow enhancement port 43 to be exposed at about the same point in the stroke of stepped intensifier piston 60 where top hat hydraulic surface 62 and top hat piston skirt portion 86 clear top hat piston bore 51. In addition, the diameters of top hat piston bore 51, larger hydraulic surface 61, and corresponding main piston bore 50 determine the hydraulic area upon which the high pressure actuation fluid will act once actuation fluid flow enhancement annulus 43 is uncovered. Furthermore, the sizes of annulus 43 and actuation fluid enhanced flow passages 40 determine the amount of actuation fluid flow capacity to which larger hydraulic surface 61 will be exposed. Preferably, passages 40 and annulus 43 are fluidly unrestricted.

In order to end the injection cycle, the electrical power to solenoid coil 24 is cut, allowing movable armature 25 and hence the pilot valve member 27, to move in a downward direction closing pilot valve low pressure seat 28. With pilot valve member 27 positioned as such, control pressure passage 30 is again exposed to high actuation fluid pressure via high pressure passage 46. Accordingly, the high pressure actuation fluid acts on direct control needle valve 80, via needle control chamber 85 and needle valve closing hydraulic surface 83, to move it towards and seat and hydraulically lock it in its lower seated position, abruptly preventing any additional fuel from exiting fuel delivery nozzle 81. This abrupt closure of direct control needle valve 80 may result in an undesirable pressure spike in the high pressure fluid passages of HEUI injector 10. Such a pressure spike is dissipated, and possible adverse effects averted and mitigated, via pressure relief passage 45, which, as explained below, is in communication with pressure relief vent 18 before, after, and in between injection cycle events.

When control pressure passage 30 is exposed to high actuation fluid, the lower annular hydraulic surface 37 of spool valve member 31 is exposed to the high actuation fluid pressure via branch control passage 38. This equalizes, the hydraulic forces acting on that member 31, and thus allows it to move towards its first and upper position, under and with the impetus, influence, and cooperation of spool valve biasing spring 32. Spool valve member 31 is also kick started in an upward direction by pressure relief valve ball 34, which at this point in the end phase of the injection cycle is still exposed to high pressure actuation fluid via pressure relief passage 45. When spool valve member 31 achieves its first and upper position, it is no longer acting to close pressure relief valve ball 34 against pressure relief valve seat 91 via actuator rod 89, thus pressure relief passage 45 is fluidic connection with pressure relieve vent 18. The opening of pressure relief valve ball 34 relieves pressure from the hydraulic surfaces of stepped intensifier piston 60 via pressure relief passage 45, allowing fluid to flow through pressure relief vent 18, and dissipating any pressure spike associated with the abrupt closure of direct control needle valve 80. With spool valve member 31 in its first and upper position, its second and upper positioned wide aspect ratio distribution groove 48 is closed to and hydraulically hidden from actuation fluid cavity 33, thus preventing actuation fluid cavity 33 from being exposed to the high actuation pressure of high pressure passage 46. Furthermore, with spool valve member 31 in its first and upper position, its first and lower positioned wide aspect ratio distribution groove 47 exposes actuation fluid cavity 33, hence the hydraulic surfaces of stepped intensifier piston 60, to actuation fluid drain 15. With no high pressure fluid acting on its hydraulic surfaces, stepped intensifier piston 60 and plunger 27 begin moving in an upward direction towards and attaining the first upper retracted position, under and with the impetus, influence, and cooperation of stepped intensifier piston return spring 68. As it moves in the upper direction, plunger 27 draws or allows to be drawn low pressure fuel into fuel pressurization chamber 68 from fuel inlet port 70 or ports 70, via various internal passages and through fuel check valve 74. Once stepped intensifier piston 60, hence plunger 70, is in its upper and retracted position, the HEUI injector 10 is ready to begin a new injection cycle.

Although this invention is illustrated in the context of a hydraulically actuated unit injector as shown in commonly-owned U.S. Pat. No. 5,826,562, for example, one skilled in the art will recognize that this invention is equally applicable to other fuel systems such as the amplifier piston common rail system (APCRS) illustrated in the paper "Heavy Duty Diesel Engines—The Potential of Injection Rate Shaping for Optimizing Emissions and Fuel Consumption", presented by Messrs. Bernd Mahr, Manfred Dürnholz, Wilhelm Polach, and Hermann Grieshaber; Robert Bosch GmbH, Stuttgart, Germany, at the 21$^{st}$ International Engine Symposium, May 4–5, 2000, Vienna, Austria.

While the present invention has been illustrated in terms of a stepped top hat type intensifier piston and an actuation fluid flow enhancement annulus, the principles involved would be applicable with pistons and ports of other and various shapes, and to other schemes designed to provide an increase in actuation fluid flow capacity at a certain point in the stroke of the stepped intensifier piston. Thus, those skilled in the art will appreciate that other aspects, objects and advantages of this invention can be obtained from a study of the drawings, the disclosure and the appended claims.

What is claimed is:

1. A hydraulically actuated fuel injector comprising:

an injector body defining an actuation fluid cavity fluidly connected to a piston bore via a plurality of actuation fluid passages;

an intensifier piston having a side surface and a top that includes a first hydraulic surface separated from a second hydraulic surface, and being positioned in said piston bore and moveable a stroke distance between a retracted position and an advanced position;

a first passage of said plurality of actuation fluid passages having a relatively unrestricted flow area;

a second passage of said plurality of actuation fluid passages having a relatively restricted flow area;

a third passage of said plurality of actuation fluid passages having a relatively unrestricted flow area and being blocked by said side surface over a portion of said stroke distance;

said first hydraulic surface being exposed to fluid pressure in a first cavity fluidly connected to said first passage over a beginning portion of said stroke distance; and said second hydraulic surface being exposed to fluid pressure in a second cavity fluidly connected to said second passage over said beginning portion of said stroke distance.

2. The fuel injector of claim 1 wherein said third passage includes an annulus that opens into said piston bore.

3. The fuel injector of claim 1 wherein said first hydraulic surface is substantially smaller than, and concentric with, said second hydraulic surface.

4. The fuel injector of claim 3 wherein said intensifier piston includes a cylindrical surface between said first hydraulic surface and said second hydraulic surface.

5. The fuel injector of claim 1 wherein said second hydraulic surface includes a stop surface in contact with said injector body when said intensifier piston is in said retracted position, but out of contact when said intensifier piston is away from said retracted position; and said first hydraulic surface being located a top hat distance above said stop surface.

6. The fuel injector of claim 5 wherein said beginning portion of said stroke distance is at least as large as said top hat distance.

7. The fuel injector of claim 5 wherein said beginning portion of said stroke distance is about equal to said top hat distance.

8. The fuel injector o f claim 7 wherein said third passage includes an annulus that opens into said piston bore; and said first hydraulic surface is substantially smaller than, and concentric with, said second hydraulic surface.

9. A directly controlled fuel injector comprising:

an injector body defining a nozzle outlet, a needle control chamber and an actuation fluid cavity fluidly connected to a piston bore via a plurality of actuation fluid passages;

an intensifier piston having a side surface and a top that includes at least one hydraulic surface, and being positioned in said piston bore and moveable a stroke distance between a retracted position and an advanced position;

one of said plurality of actuation fluid passages being blocked by said side surface over a portion of said stroke distance; and a direct control needle valve including a needle valve member positioned in said injector body adjacent said nozzle outlet and including a closing hydraulic surface exposed to fluid pressure in said needle control chamber.

10. A directly controlled fuel injector comprising:

an injector body defining a nozzle outlet, a needle control chamber and an actuation fluid cavity fluidly connected to a piston bore via a plurality of actuation fluid passages;

an intensifier piston having a side surface and a top that includes at least one hydraulic surface, and being positioned in said piston bore and moveable a stroke distance between a retracted position and an advanced position;

one of said plurality of actuation fluid passages being blocked by said side surface over a portion of said stroke distance;

a needle valve member positioned in said injector body adjacent said nozzle outlet and including a closing hydraulic surface exposed to fluid pressure in said needle control chamber; and said one of said plurality of actuation fluid passages includes an annulus that opens into said piston bore.

11. The fuel injector of claim 10 wherein said intensifier piston includes a stepped top with a cylindrical surface between a first hydraulic surface and a second hydraulic surface.

12. The fuel injector of claim 11 wherein said one of said plurality of actuation fluid passages has a relatively unrestricted flow area;

a second of said plurality of actuation fluid passages has a relatively restricted flow area; and said second hydraulic surface being exposed to fluid pressure in a second cavity fluidly connected to said second of said plurality of actuation fluid passages over a beginning portion of said stroke distance.

13. The fuel injector of claim 12 wherein said second hydraulic surface includes a stop surface in contact with said injector body when said intensifier piston is in said retracted position, but out of contact when said intensifier piston is away from said retracted position; and said first hydraulic surface being located a top hat distance above said stop surface.

14. The fuel injector of claim 13 wherein said beginning portion of said stroke distance is at least as large as said top hat distance.

15. The fuel injector of claim 13 wherein said beginning portion of said stroke distance is about equal to said top hat distance.

16. A method of front end rate shaping in a hydraulically actuated fuel injector, comprising the steps of:

driving an intensifier piston of a hydraulically actuated fuel injector over a beginning portion of its stroke with a small hydraulic force at least in part by covering one of a plurality of actuation fluid passages with the intensifier piston over the beginning portion of the stroke;

opening a nozzle outlet of the fuel injector at least in part by relieving hydraulic pressure on a closing hydraulic surface of a needle valve member; and driving the intensifier piston with a large hydraulic force for an other portion of its stroke at least in part by moving the intensifier piston to a position that uncovers the one actuation fluid passage; and closing the nozzle outlet at least in part by resuming hydraulic pressure on the closing hydraulic surface of the needle valve member.

17. The method of claim 16 wherein the intensifier piston has a first hydraulic surface separated from a second hydraulic surface;

said step of driving the intensifier piston with a small hydraulic force includes the steps of:

exposing the second hydraulic surface to actuation fluid at a relatively low pressure; and exposing the first hydraulic surface to actuation fluid at a relatively high pressure.

18. The method of claim 17 wherein said step of driving the intensifier piston with a large hydraulic force includes the step of:

exposing the first hydraulic surface and the second hydraulic surface to actuation fluid at a relatively high pressure at least in part by moving the intensifier piston to a position at which a top hat portion is out of a top hat bore.

19. The method of claim 18 wherein the steps of moving the intensifier piston to a position that uncovers the one actuation fluid passage and moving the intensifier piston to a position at which a top hat portion is out of a top hat bore occur at about the same time.

20. The method of claim 19 wherein the step of exposing the second hydraulic surface to actuation fluid at a relatively low pressure includes the steps of:

exposing the second hydraulic surface to fluid pressure in a cavity; and restricting flow of actuation fluid to the cavity.

* * * * *